US009494034B2

(12) United States Patent
Martin et al.

(10) Patent No.: US 9,494,034 B2
(45) Date of Patent: Nov. 15, 2016

(54) METHOD AND APPARATUS FOR ACOUSTIC NOISE ISOLATION IN A SUBTERRANEAN WELL

(75) Inventors: Adam Harold Martin, Addison, TX (US); Zeke Shashoua, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 187 days.

(21) Appl. No.: 13/822,307

(22) PCT Filed: Mar. 12, 2012

(86) PCT No.: PCT/US2012/028702

§ 371 (c)(1),
(2), (4) Date: Dec. 9, 2014

(87) PCT Pub. No.: WO2013/137845

PCT Pub. Date: Sep. 19, 2013

(65) Prior Publication Data

US 2015/0117152 A1 Apr. 30, 2015

(51) Int. Cl.
*G01V 3/00* (2006.01)
*E21B 47/14* (2006.01)
(Continued)

(52) U.S. Cl.
CPC ..... *E21B 47/14* (2013.01); *E21B 17/1042* (2013.01); *E21B 17/1078* (2013.01); *E21B 47/16* (2013.01)

(58) Field of Classification Search
CPC ..... E21B 47/16; E21B 47/18; E21B 47/182; E21B 47/187; E21B 47/14; E21B 47/122; E21B 17/028; E21B 41/0085; E21B 47/123; E21B 23/04; E21B 17/1078; E21B 47/101; E21B 47/00; E21B 17/1021; E21B 17/1042; E21B 2021/005; E21B 21/08; E21B 34/06; E21B 37/02; E21B 44/00; E21B 47/024; E21B 47/06; E21B 47/12; E21B 47/185; E21B 49/00; Y10S 367/911; G10K 9/12; G10K 9/121; G10K 11/16; F16F 15/00
USPC ..... 340/853.2, 853.6–853.7, 856.4; 367/81–85
See application file for complete search history.

(56) References Cited

U.S. PATENT DOCUMENTS 3,410,613 A 11/1968 Kuus
3,949,352 A 4/1976 Vogel
(Continued)

FOREIGN PATENT DOCUMENTS

WO 2013137845 A1 9/2013

OTHER PUBLICATIONS

Official Action for European Patent Application No. 12871409.4 dated Nov. 11, 2015.
(Continued)

*Primary Examiner* — Emily C Terrell
(74) *Attorney, Agent, or Firm* — McDermott Will & Emery LLP; John Wustenberg

(57) ABSTRACT

The disclosure provides a well system component configured to reduce excessive acoustic noise that would otherwise interfere with acoustic telemetry systems. Specifically, the well system component includes a body configured to be coupled to a pipe string, at least one lobe extending radially from the body, and a pad disposed on the at least one lobe and extending radially from an outer radial extent of the at least one lobe. The well system component can be installed at critical acoustic transmission locations, such as at the location of a hanger, at or near a flex joint in a wellhead installation, and/or at or near a rig floor or deck of an offshore rig.

19 Claims, 3 Drawing Sheets

(51) Int. Cl.

| | |
|---|---|
| ***G01V 1/40*** | (2006.01) |
| ***E21B 47/16*** | (2006.01) |
| ***E21B 47/18*** | (2012.01) |
| ***E21B 17/10*** | (2006.01) |

(56) References Cited

U.S. PATENT DOCUMENTS

| | | | | |
|---|---|---|---|---|
| 3,991,850 | A | 11/1976 | Escaron | |
| 4,785,300 | A | 11/1988 | Chin et al. | |
| 4,823,125 | A * | 4/1989 | Rorden | E21B 17/1021 166/250.11 |
| 4,938,299 | A | 7/1990 | Jelsma | |
| 5,250,806 | A | 10/1993 | Rhein-Knudsen et al. | |
| 5,937,948 | A * | 8/1999 | Robbins, III | E21B 17/1042 166/241.6 |
| 6,910,534 | B2 * | 6/2005 | Linyaev | E21B 47/011 166/241.7 |
| 7,048,064 | B1 * | 5/2006 | Smith | E21B 17/1078 166/382 |
| 7,301,472 | B2 | 11/2007 | Kyle et al. | |
| 2003/0010540 | A1 | 1/2003 | Kirk et al. | |
| 2005/0092527 | A1 | 5/2005 | Le et al. | |
| 2008/0164019 | A1 | 7/2008 | Angman | |
| 2008/0217063 | A1 | 9/2008 | Moore et al. | |
| 2010/0097890 | A1 * | 4/2010 | Sullivan | E21B 17/028 367/82 |
| 2010/0326731 | A1 | 12/2010 | Swietlik et al. | |
| 2011/0286307 | A1 * | 11/2011 | Wang | G01V 1/46 367/82 |

OTHER PUBLICATIONS

International Preliminary Report on Patentability for PCT/US2012/028702 dated Sep. 25, 2014.

Official Action for Australian Patent Application No. 2012373304 dated Jun. 29, 2015.

* cited by examiner

METHOD AND APPARATUS FOR ACOUSTIC NOISE ISOLATION IN A SUBTERRANEAN WELL

CROSS-REFERENCE TO RELATED APPLICATIONS

The present application is a National Stage entry of and claims priority to International Application No. PCT/US2012/28702 filed on Mar. 12, 2012.

BACKGROUND

The present invention relates generally to subterranean well systems and, more particularly, to well system components that reduce excessive acoustic noise that would otherwise interfere with acoustic telemetry systems.

In subterranean well completions, a metal tubing structure, such as a pipe string, is typically supported from an appropriate metal hanger structure and extends downwardly therefrom through a wellbore portion of the completion which is normally lined with a metal casing. In subsea applications, the hanger will typically rest within a wellhead installation arranged on the seabed floor where one or more blow out preventers are used to instantaneously cut off hydrocarbon production in the event a production problem arises. A marine riser extends upwardly from the wellhead installation to the surface and provides a conduit for the tubing to penetrate the seabed floor and access hydrocarbon reservoirs for production.

During hydrocarbon production, it is often desirable to monitor the state of various downhole well parameters, such as the temperature and pressure within the tubing and external to the tubing in the annulus defined between the tubing and the casing. Many times the desired sensing locations for these well parameters are thousands of feet downhole. Thus, signals indicative of the sensed well parameters must be transmitted upwardly via the tubing over great distances through the wellbore, and also through a lengthy marine riser in subsea applications, to a predetermined signal receiving location.

Various techniques have previously been proposed for generating and transmitting these well parameter signals. One such technique is acoustic telemetry which functions by transmitting data through vibrations propagating in the wall of the tubing. The vibrations are typically generated by an acoustic transmitter mounted on the tubing and propagate along the tubing to an acoustic receiver also mounted on the tubing for conversion to, for example, digital or analog electrical signals.

Acoustic telemetry systems often encounter technical obstacles, however, especially in subsea applications where changing sea conditions can affect accurate acoustic transmission. For example, as the riser shifts in response to changes in the sea currents, the tubing may shift within the riser and the wellhead installation and thereby generate acoustic noise. In extreme conditions, the tubing may even strike the riser and/or wellhead installation. This excessive acoustic noise has the effect of reducing acoustic communication reliability. Attempts to improve acoustic transmission reliability have focused generally on optimizing the acoustic transmission frequencies, clamping mechanisms, and acoustic power/signal strength. Such solutions, however, can be complex and oftentimes costly.

SUMMARY OF THE INVENTION

The present invention relates generally to subterranean well systems and, more particularly, to well system components that reduce excessive acoustic noise that would otherwise interfere with acoustic telemetry systems.

In some embodiments, a well system component for reducing excessive acoustic noise in downhole acoustic telemetry systems is disclosed. The well system component may include a body configured to be coupled to a pipe string, and at least one lobe extending radially from the body. The well system component may also include a pad disposed on the at least one lobe and extending radially from an outer radial extent of the at least one lobe, the pad being configured to reduce acoustic noise generated within a marine riser and/or a wellhead installation.

In some embodiments, a method for reducing excessive acoustic noise in a downhole acoustic telemetry system is disclosed. The method may include arranging a well system component about a pipe string. The first well system component may include a body, at least one lobe extending radially from the body, and a pad disposed on the at least one lobe. The method may also include contacting the pad against an inner wall of a marine riser and/or a wellhead installation, and absorbing with the pad acoustic noise generated within the marine riser and/or the wellhead installation, thereby improving acoustic communication in the acoustic telemetry system.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates generally to subterranean well systems and, more particularly, to well system components that reduce excessive acoustic noise that would otherwise interfere with acoustic telemetry systems.

The present invention provides systems and methods for dampening or otherwise reducing excessive acoustic noise generated within subterranean well completions that utilize acoustic telemetry to transmit pertinent wellbore data. Excessive acoustic noise negatively affects communication reliability in the acoustic telemetry systems, thus making it difficult to ascertain accurate wellbore conditions or otherwise significantly curtailing accurate signal communication with downhole tools. The well system components and embodiments disclosed herein may be installed or otherwise arranged at locations of the subterranean well completion where an increased amount of acoustic noise is likely to occur and even expected. As a result, unwanted acoustic noise is significantly reduced and the reliability of the acoustic telemetry system increases when communicating wirelessly through oil and gas tool strings and/or subsea safety landing strings or tubulars.

Figure 1:
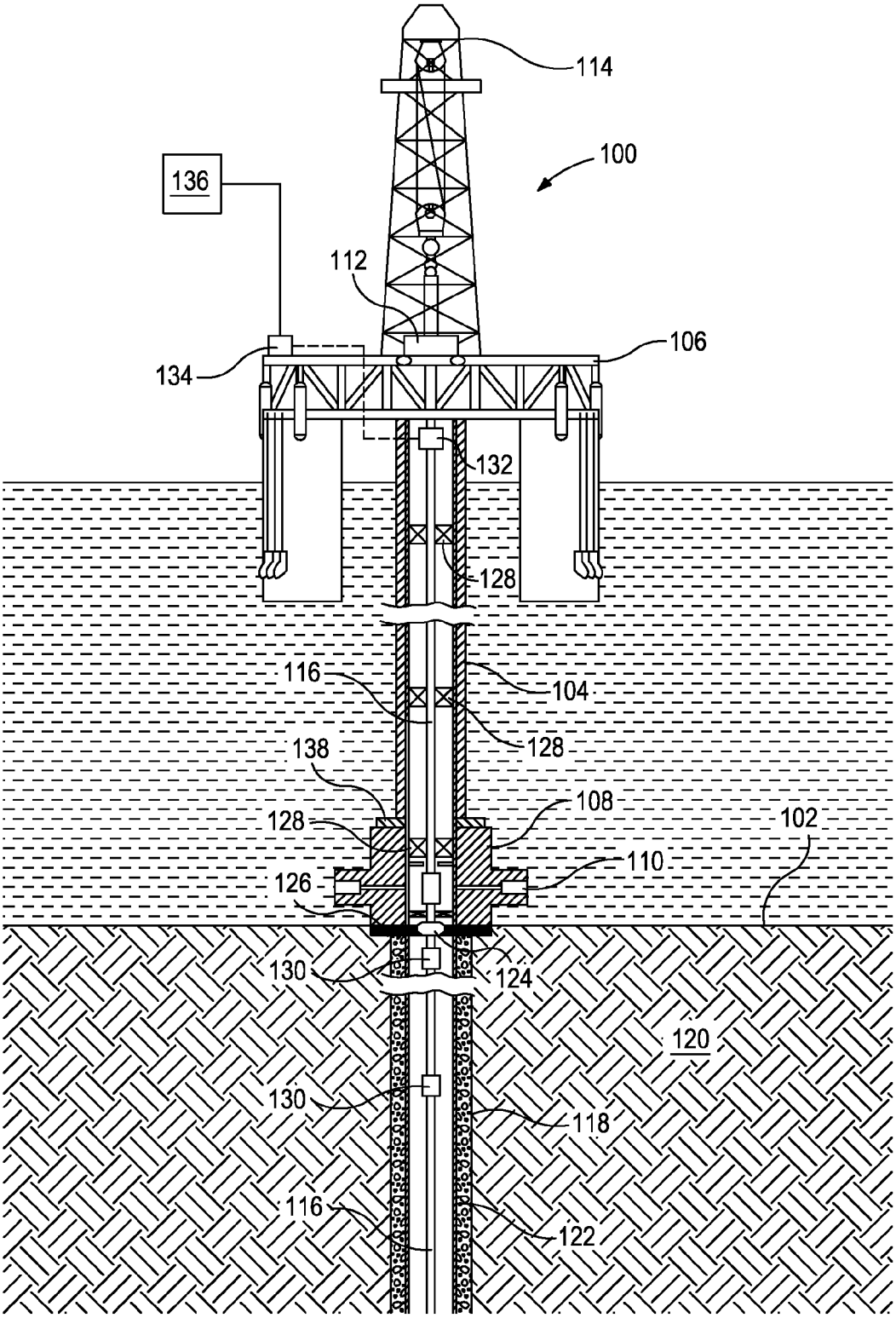
FIG. 1 illustrates a semi-submersible offshore rig installation using one or more exemplary well system components, according to one or more embodiments disclosed.

Referring to FIG. 1, illustrated is a semi-submersible offshore rig installation 100 that can be centered over a submerged oil and gas formation (not shown) located below the sea floor 102. A marine riser 104 extends from the deck 106 of the offshore rig installation 100 to a wellhead installation 108 established at the sea floor 102. The wellhead installation 108 may include one or more blowout preventers 110, as generally known in the art. The offshore rig installation 100 has a hoisting apparatus 112 and a derrick 114 for raising and lowering a pipe string 116. The term "pipe string," as used herein, may refer to one or more types of connected lengths of tubulars as known in the art, and may include, but is not limited to, drill string, landing string, production tubing, combinations thereof, or the like.

A wellbore 118 extends below the wellhead installation 108 and has been drilled through various earth strata 120, including one or more oil and gas formations (not shown). A casing string 122 is cemented within the wellbore 118. The term "casing" is used herein to designate a tubular string used to line a wellbore. Casing may actually be of the type known to those skilled in the art as "liner" and may be made of any material, such as steel or composite material and may be segmented or continuous, such as coiled tubing.

Operatively disposed at the sea floor 102, and within the wellhead installation 108, is a hanger 124 anchored to the pipe string 116 and a wear bushing 126 complementarily engaged by the hanger 124. The cooperative engagement of the hanger 124 and the wear bushing 126 may be configured to generally suspend the pipe string 116 within the wellbore 118 and/or otherwise support the pipe string 116 within the marine riser 104 as it extends from the deck 106. One or more centralizers 128 (three are shown) may be arranged at strategic locations along the pipe string 116 in order to maintain the pipe string 116 centrally disposed within the marine riser 104 and/or the wellhead installation 108.

Also illustrated in FIG. 1 is an exemplary wireless telemetry system that may be characterized as an acoustic telemetry system. The telemetry system may include at least one or more wireless inline repeaters 130 and a surface transceiver 132. The repeaters 130 are configured to receive and transmit data along the pipe string 116 and communicate with the surface transceiver 132. The repeaters 130 may be bi-directional, i.e., configured to receive uplink and downlink telemetry signals. As used herein, the term "uplink" refers to telemetry signals generally directed towards the surface or offshore rig installation 100. Conversely, the term "downlink" refers to signals generally directed towards the bottom of the wellbore 118 and/or the end of the pipe string 116.

In operation, the wireless telemetry system may be configured to ascertain and transmit pertinent wellbore data via an uplink transmission. The pertinent wellbore data may include, but is not limited to, downhole pressure and temperature conditions. The wellbore data may first be collected using a downhole tool (not shown) configured to record measurements taken by one or more downhole sensors, as are well known in the art. The collected data is transmitted as uplink data using, for example, a downhole transmitter configured to modulate the data into an acoustic signal that is transmittable along the pipe string 116 and received by an axially adjacent first wireless inline repeater 130. The first repeater 130 may detect and demodulate the acoustic signal. As part of the demodulation process, the first wireless inline repeater 130 may perform amplification, filtering, analog-to-digital conversion, buffering, and/or error correction on the received data. The first wireless inline repeater 130 then transmits the acoustic uplink data as a new acoustic uplink signal to a succeeding, axially-adjacent second wireless inline repeater 130 or alternatively, depending on its relative position on the pipe string 116, to the surface transceiver 132 arranged at the surface. In order to transmit the acoustic uplink signal, each wireless inline repeater 130 may be equipped with an acoustic transducer configured to generate modulated acoustic vibrations on the pipe string 116.

The surface transceiver 132 may include one or more accelerometers or other acoustic sensors coupled to the pipe string 116 and used to detect the acoustic uplink signal being transmitted from the wireless inline repeaters 130. The surface transceiver 132 then forwards the detected data to a demodulator 134 which demodulates the received data and transmits it to computing equipment 136 communicably coupled thereto. The computing equipment 136 may be configured to analyze the received data and extract the pertinent wellbore information. As a result, real-time downhole pressure and temperature conditions may be viewed and considered by rig operators. Any downlink signals sent from the surface transceiver 132 may be handled in substantially the same fashion as the uplink signal, and therefore will not be described in detail.

Since acoustic telemetry systems depend on acoustic energy propagated along the length of the pipe string 116, external acoustic noise may interfere with proper transmission and therefore diminish communication reliability. In subsea applications, such as shown in FIG. 1, one critical acoustic transmission location is found at the location of the hanger 124 where all or most of the weight of the pipe string 116 rests. Because of the immense compression and tension change experienced by the pipe string 116 at this location, a significant amount of acoustic communication strength can be lost and dissipated into the wellhead installation 108 or sea floor 102.

Another critical location for acoustic transmission is found at or near the transition location from the wellhead installation 108 to the marine riser 104. In some embodiments, a flex joint 138 may be installed in the wellhead installation 108 at the transition location and provide a flexible coupling for sealingly connecting the wellhead installation 108 to the marine riser 104. As the sea currents change and the marine riser 104 shifts in response to the changing sea currents, the flex joint 138 provides an amount of flexure that maintains the sealed connection. Nevertheless, acoustic noise often results at or near the flex joint 138. The generated acoustic noise can have a detrimental effect on uplink and downlink acoustic telemetry transmission.

At least one more critical location that may affect reliable acoustic transmission is at or near the rig floor or deck 106 where high noise levels also often occur. For example, acoustic noise often results from the work undertaken on the deck 106, but can also be generated within the riser 104 as the sea currents change and the pipe string 116 shifts and translates therein. This generated noise is often translated directly to the pipe string 116 and detrimentally affects uplink and downlink acoustic telemetry transmission.

Figure 2A:
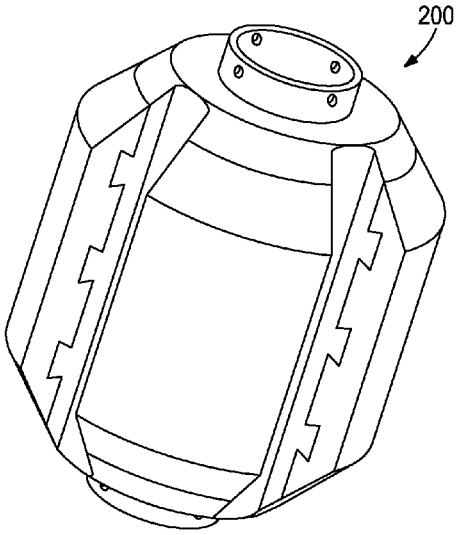
FIG. 2*a* illustrates an isometric view of an exemplary centralizer, according to one or more embodiments disclosed.
Figure 2B:
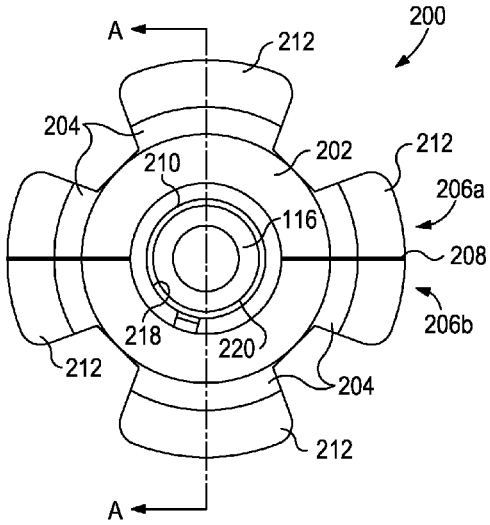
FIG. 2*b* illustrates an end view of the exemplary centralizer of FIG. 2*a*, according to one or more embodiments disclosed.
Figure 2C:
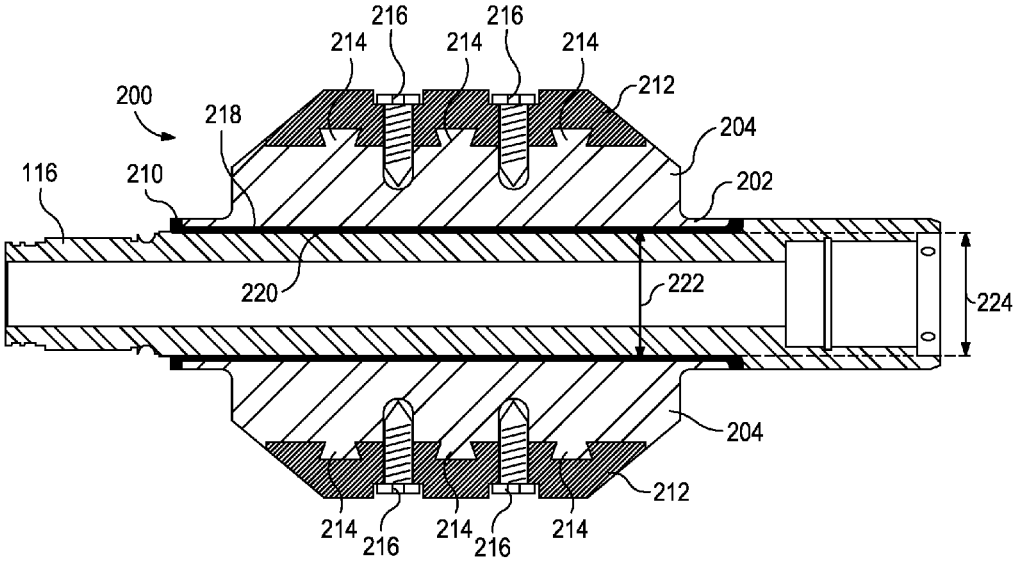
FIG. 2*c* illustrates a cross-sectional view of the exemplary centralizer of FIG. 2*a*, as taken along lines A-A in FIG. 2*b*, according to one or more embodiments disclosed.

Referring now to FIGS. 2*a*, 2*b*, and 2*c*, illustrated are isometric, end, and cross-sectional views, respectively, of an exemplary well system component 200, according to one or more embodiments. Specifically, FIG. 2*c* is a cross-sectional view of the well system component 200 as taken along lines A-A in FIG. 2*b*. The well system component 200 may be characterized as a centralizer, and may be somewhat similar to the centralizers 128 described above with reference to FIG. 1, but modified as described herein to dampen or otherwise reduce excessive acoustic noise within the marine riser 104 and/or the wellhead installation 108 (FIG. 1).

As shown in FIG. 2*b*, the well system component 200 may include a centralizer body 202 that defines a plurality of centralizer lobes 204 extending radially therefrom. While four centralizer lobes 204 are illustrated, it will be appreciated that more or less than four centralizer lobes 204 may be defined, without departing from the scope of the disclosure. In some embodiments, the centralizer lobes 204 may be equidistantly spaced about the circumference of the centralizer body 202, as illustrated, but in other embodiments they may be randomly spaced.

In one or more embodiments, the centralizer body 202 may be formed of two arcuate halves, such as a first centralizer half 206*a* and a second centralizer half 206*b*. The first and second centralizer halves 206*a,b* may be mutually joined at a common seam 208 in order to couple or otherwise attach the well system component 200 to an outer circumferential surface 220 of the pipe string 116. In at least one embodiment, the first and second centralizer halves 206*a,b* may be coupled together using one or more mechanical fasteners (not shown), such as bolts. Once properly coupled to the pipe string 116, the well system component 200 may be immovably secured thereto.

Each centralizer lobe 204 may include, or otherwise have disposed thereon, a centralizer pad 212 extending radially from the outer radial extent of the corresponding centralizer lobe 204. In operation, the centralizer pad 212 may be configured to absorb or otherwise reduce acoustic noise generated within the marine riser 104 and the wellhead installation 108 (FIG. 1), and thereby improve acoustic communication reliability in the acoustic telemetry system. To accomplish this, the centralizer pad 212 may be made of an acoustic dampening material. In some embodiments, the acoustic dampening material may be, but is not limited to, any type or grade of elastomer. For example, in some embodiments the centralizer pad 212 may be made of a hydrogenated nitrile butadiene rubber (HNBR), such as THERBAN® or ZETPOL®. In other embodiments, the centralizer pad 212 may be made of variations of carboxylated nitrile (XNBR) to further aid in abrasion resistance and yield strength. Further, phenolic variations, such as glass filled phenolic, may be used to provide additional abrasion resistance and dimensional stability.

The centralizer pad 212 may be coupled or otherwise attached to a corresponding centralizer lobe 204 in a variety of ways. For example, the centralizer pad 212 may be molded onto the corresponding centralizer lobe 204 and allowed to cure, such that it forms or otherwise becomes an integral portion of the centralizer lobe 204. In some embodiments, one or more dove-tail protrusions 214 may be defined on the outer radial surface of the centralizer lobe 204 and serve to help maintain the molded centralizer pad 212 coupled to the centralizer lobe 204.

In other embodiments, the centralizer pad 212 may be coupled to a corresponding centralizer lobe 204 using one or more mechanical fasteners 216, such as bolts. Each mechanical fastener 216 may be set within corresponding and contiguous apertures defined in both the centralizer pad 212 and the centralizer lobe 204. As illustrated, the mechanical fasteners 216 may be inlaid such that they do not protrude past the outer radial extent of the centralizer pad 212, thereby preventing the mechanical fasteners 216 from contacting the inner wall of the marine riser 104 and/or the wellhead installation 108 (FIG. 1) and thereby adding additional acoustic noise.

In yet other embodiments, a combination of molding and mechanically fastening the centralizer pad 212 to a corresponding centralizer lobe 204 may be employed. Alternatively, the well system component 200 may include one or more centralizer lobes 204 having corresponding centralizer pads 212 molded thereon, and one or more other centralizer lobes 204 having corresponding centralizer pads 212 mechanically fastened thereto, without departing from the scope of the disclosure. In yet other embodiments, the centralizer pad 212 may be affixed to the corresponding centralizer lobe 204 by mechanically trapping the material of the centralizer pad 212 on either end(s) of the corresponding centralizer lobe 204 such that centralizer pad 212 is effectively constrained, yet capable to perform its function as a centralizing member without contact inference with the mechanical member(s) constraining the centralizer pad 212 to the centralizer lobe 204.

As best seen in FIG. 2*c*, the well system component 200 may further include a sleeve 210 that generally interposes the centralizer body 202 and the pipe string 116. Specifically, the sleeve 210 engages an inner circumferential surface 218 of the centralizer body 202 and the outer circumferential surface 220 of the pipe string 116. In one or more embodiments, the sleeve 210 may be configured to help attenuate or otherwise reduce acoustic noise propagated through the pipe string 116. In operation, the sleeve 210 may be configured to dampen the harshness or roughness of excessive acoustic noise, while allowing the tuned acoustic signal to properly propagate through the pipe string 116 and therefore allow for a clearer reception of the signal.

To accomplish this, the sleeve 210 may be made of, for example, the same type of acoustic dampening material as the centralizer pad 212. In other embodiments, however, the respective materials of each component may differ in type and/or grade. For example, in some embodiments, the sleeve 210 may be made of a material that is softer than that of the centralizer pad 212. Moreover, the centralizer pad 212 may include abrasion resistant properties. As a result, the sleeve 210 may be better able to attenuate excessive acoustic noise propagated along the pipe string 116, while the centralizer pad 212 may be better able to withstand long term rubbing or chaffing against the inner wall of the marine riser 104 or the wellhead installation 108 (FIG. 1).

In some embodiments, the sleeve 210 may exhibit a hardness of about 70 durometer, and the centralizer pad 212 may exhibit a hardness of about 80 durometer. As will be appreciated, however, the hardness of the sleeve 210 and the centralizer pad 212 may vary greatly, depending on the application. For example, the hardness of the sleeve 210 may be greater or less than 70 durometer, and the hardness of the centralizer pad 212 may be greater or less than 80 durometer, without departing from the scope of the disclosure. In other embodiments, the sleeve 210 may be made of a material that is harder than that of the centralizer pad 212. Those skilled in the art will readily recognize that many variations in hardness, materials used, and configurations may be realized, without departing from the scope of the disclosure. Moreover, it will readily be understood that this provides versatility in fine tuning the acoustic dampening properties of the well system component 200.

Figure 3A:
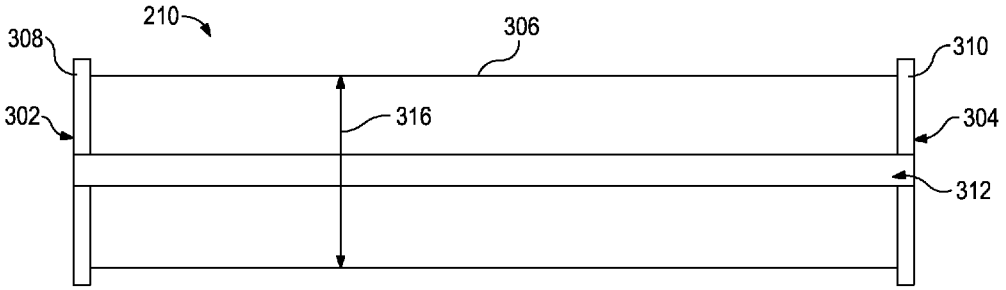
FIG. 3*a* illustrates a side view of an exemplary centralizer sleeve, according to one or more embodiments disclosed.
Figure 3B:
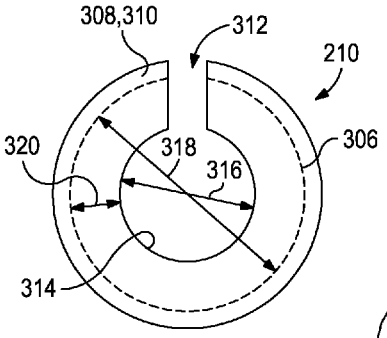
FIG. 3*b* illustrates an end view of the exemplary centralizer sleeve of FIG. 3*a*, according to one or more embodiments disclosed.

Referring to FIGS. 3*a* and 3*b*, with continued reference to FIG. 2*c*, illustrated are side and end views, respectively, of the exemplary sleeve 210. The sleeve 210 may have a first axial end 302, a second axial end 304, and an elongate section 306 extending between the first and second axial ends 302, 304. The first axial end 302 may define a first flange portion 308 and the second axial end 304 may define a second flange portion 310. As illustrated, the first and second flange portions 308, 310 may extend radially outward from the elongate section 306.

The sleeve 210 may further define a radial slot 312 configured to allow the sleeve 210 to be arranged or otherwise disposed about the pipe string 116 (FIG. 2*c*). Once arranged about the pipe string 116, an inner circumferential surface 314 of the sleeve 210 may be configured to engage the outer circumferential surface 220 (FIG. 2*c*) of the pipe string 116. Moreover, the elongate section 306 may be configured to seat, engage, or otherwise receive the inner circumferential surface 218 (FIG. 2*c*) of the centralizer body 202, and the first and second flange portions 308, 310 may be configured to axially bound the centralizer body 202 and maintain the centralizer body 202 centered on the sleeve 210 during operation.

The inner circumferential surface 314 of the sleeve 210 may have an inner diameter 316 that generally corresponds to an outer diameter 224 (FIG. 2*c*) of the pipe string 116, and the elongate section 306 may have an outer diameter 318 that generally corresponds to the inner diameter 222 (FIG. 2*c*) of the centralizer body 202. Consequently, the sleeve 210 may define a radial thickness 320 generally equal to the difference between the inner diameter 316 and the outer diameter 318 of the sleeve 210. In one or more embodiments, the radial thickness 320 of the sleeve 210 may vary in order to accommodate varying sizes of pipe string 116 (i.e., varying outer diameters 224 (FIG. 2*c*). For example, the inner diameter 316 of the sleeve 210 may be sized to fit the corresponding size of the outer diameter 224 (FIG. 2*c*) of the selected pipe string 116. Meanwhile, the outer diameter 318 of the sleeve 210 may remain generally constant in order to accommodate a universal size of the centralizer body 202. As a result, the same centralizer body 202 may be used across multiple applications while a properly dimensioned sleeve 210 may be selected in order to appropriately attach the well system component 200 to the corresponding outer diameter 224 (FIG. 2*c*) of the pipe string 116.

The variability of the radial thickness 320 (e.g., inner diameter 316) of the sleeve 210 may prove advantageous since it is often unknown what size pipe string 116 the well system component 200 must be clamped to until encountering the actual pipe string 116 on site and it can be quite costly to design centralizer bodies 202 to fit varying sizes of pipe string 116. Hence, instead of varying the size of the centralizer body 202, a properly-dimensioned sleeve 210 may be selected to suitably couple the well system component 200 to the pipe string 116.

Figure 4A:
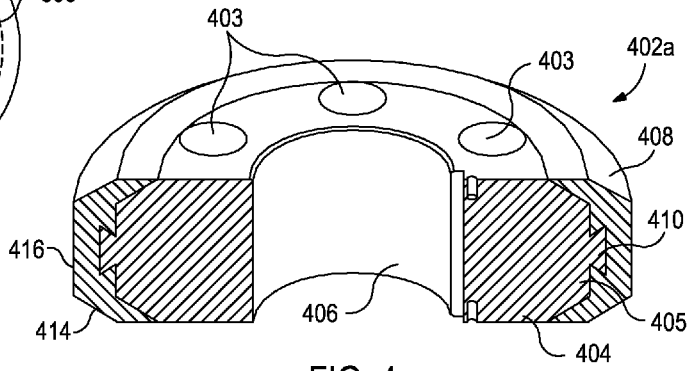
FIG. 4*a* illustrates an isometric, cross-sectional view of an exemplary hanger, according to one or more embodiments disclosed.
Figure 4B:
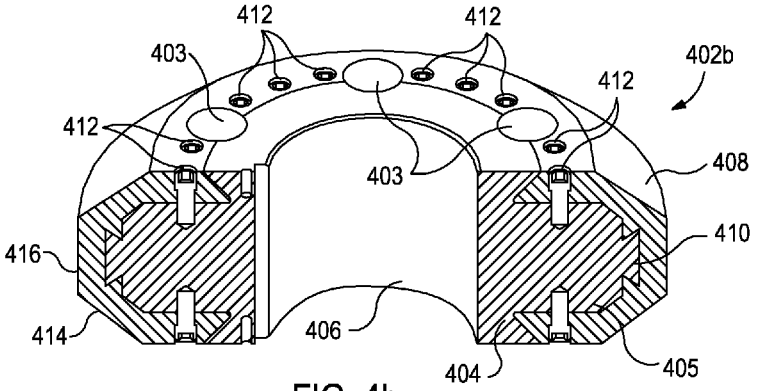
FIG. 4*b* illustrates an isometric, cross-sectional view of another exemplary hanger, according to one or more embodiments disclosed.

Referring now to FIGS. 4*a* and 4*b*, with continued reference to FIG. 1, illustrated are isometric, cross-sectional views of exemplary well system components 402*a* and 402*b*, respectively, according to one or more embodiments. The well system components 402*a,b* may be characterized as hangers and somewhat similar to the hanger 124 described above with reference to FIG. 1, but modified as described herein to dampen or otherwise reduce excessive acoustic noise within the wellhead installation 108 (FIG. 1). In one or more embodiments, the well system components 402*a,b* may define one or more apertures 403 and thereby be characterized as "fluted" hangers, as known in the art. The well system components 402*a,b* may each be configured to be coupled or otherwise immovably attached to the pipe string 116 (FIG. 1). Each well system component 402*a,b* may include an arcuate hanger body 404 configured to extend around the outer circumferential surface 220 (FIG. 2*c*) of the pipe string 116 (FIG. 1). Specifically, the well system components 402*a,b* may each define an inner radial surface 406 configured to bias against the outer circumferential surface 220 (FIG. 2*c*) of the pipe string 116 (FIG. 1) when the well system component 402*a,b* is properly installed.

Each well system component 402*a,b* may further include a hanger lobe 405 extending radially from the hanger body 404. Moreover, a hanger pad 408 may be disposed on the hanger lobe 405 and/or otherwise extending radially from the hanger lobe 405. In operation, the hanger pad 408 may be configured to absorb or otherwise reduce acoustic noise generated within the wellhead installation 108 (FIG. 1), and thereby improve acoustic communication reliability in an acoustic telemetry system. To accomplish this, similar to the centralizer pad 212 described above with reference to FIGS. 2*a*-2*c*, the hanger pad 408 may be made of an acoustic dampening material, such as, but not limited to, any type or grade of elastomer. For example, the hanger pad 408 may be made of hydrogenated nitrile butadiene rubber (HNBR), such as THERBAN® or ZETPOL®. In other embodiments, the hangar pad 408 may be made of variations of carboxylated nitrile (XNBR) to further aid in abrasion resistance and yield strength. For example, the hangar pad 408 may be made of N4263A90-XNBR in order to increase hardness, modulus, and toughness for extrusion resistance and increased abrasion resistance.

Similar to the well system component 200 described above, the hanger pad 408 may be coupled or otherwise attached to the hanger lobe 405 in a variety of ways. For example, the hanger pad 408 may be molded onto the corresponding hanger lobe 405 and allowed to cure, such that it forms or otherwise becomes an integral portion of the hanger body 404. To help maintain the molded hanger pad 408 coupled to the hanger lobe 405, one or more dove-tail protrusions 410 may be defined on the outer radial surface of the hanger lobe 405.

In other embodiments, such as is shown in FIG. 4*b*, the hanger pad 408 may be mechanically fastened to the hanger lobe 405 or hanger body 404 using one or more mechanical fasteners 412, such as bolts or the like. Each mechanical fastener 412 may be set within corresponding and contiguous apertures defined in both the hanger pad 408 and the hanger lobe 405 (or hanger body 404). In yet other embodiments, a combination of molding and mechanically fastening the hanger pad 408 to the hanger lobe 405 may be employed. Moreover, although the mechanical fasteners 412 are shown as extending from axial surfaces of the hanger lobe 405 or hanger body 404, it is also contemplated herein that the mechanical fasteners 412 extend from radial surfaces of the hanger lobe 405 or hanger body 404, without departing from the scope of the disclosure.

The hanger pad 408 of each well system component 402*a,b* may further define a tapered biasing surface 414 and a radial biasing surface 416.

The tapered biasing surface 414 may be configured to engage or otherwise bias against the wear bushing 126 (FIG. 1), and the radial biasing surface 416 may be configured to engage or otherwise bias against an inner wall of the wellhead installation 108 (FIG. 1). In at least one embodiment, the acoustic dampening material may be disposed on the wear bushing 126 (FIG. 1) as well, or only on the wear bushing 126, without departing from the scope of the disclosure. In operation, the hanger pad 408 of each well system component 402*a,b* may be configured to absorb or otherwise dampen the harshness or roughness of excessive acoustic noise, while allowing the tuned acoustic signal to properly propagate through the well system component 402*a,b* and attached pipe string 116, thereby allowing for a clearer reception of the signal.

Those skilled in the art will readily recognize the advantages in using the well system components described herein as the well system component 200 of FIGS. 2*a-c* and the well system component(s) 402*a,b* of FIGS. 4*a-b*. Adding an acoustic material to the well system component 200 and well system component(s) 402*a,b* may reduce noise from conventional metal-to-metal bearing/bending contact locations. As a result, full and effective acoustic transmission (i.e., wireless communication) may be realized through the pipe string 116 (FIG. 1).

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A well system component for reducing acoustic noise in downhole acoustic telemetry systems, comprising:

a body configured to be coupled to a pipe string suspended within a wellbore to prevent axial movement of the pipe string;

at least one lobe extending radially from the body;

one or more dove-tail protrusions extending radially outward from the at least one lobe; and a pad disposed on the at least one lobe and the one or more dove-tail protrusions and extending radially from an outer radial extent of the at least one lobe.

2. The well system component of claim 1, wherein the pad is made of an acoustic dampening material.

3. The well system component of claim 2, wherein the acoustic dampening material is an elastomer.

4. The well system component of claim 2, wherein the acoustic dampening material is a hydrogenated nitrile butadiene rubber.

5. The well system component of claim 1, wherein the pad is molded onto the at least one lobe and the one or more dove-tail protrusions.

6. The well system component of claim 1, wherein the pad is mechanically fastened to the at least one lobe.

7. The well system component of claim 1, further comprising a sleeve configured to interpose the body and the pipe string, the sleeve comprising:

a first end and a second end;

an elongate section extending between the first and second ends, the elongate section being configured to engage an inner circumferential surface of the body and providing an outer diameter of the sleeve; and an inner circumferential surface configured to engage an outer circumferential surface of the pipe string and providing an inner diameter of the sleeve.

8. The well system component of claim 7, wherein the sleeve defines a radial thickness equal to a difference between the inner diameter and the outer diameter of the sleeve, the radial thickness being sized to accommodate a corresponding size of the pipe string.

9. The well system component of claim 7, wherein the sleeve is made of an acoustic dampening material.

10. The well system component of claim 7, wherein the body is formed of a first arcuate half and a second arcuate half, the first and second halves being coupled together at a common seam and surrounding the sleeve.

11. A method for reducing acoustic noise in a downhole acoustic telemetry system, comprising:

suspending a pipe string into a wellbore and axially supporting the pipe string against axial movement;

arranging a well system component about the pipe string, the well system component comprising a body, at least one lobe extending radially from the body, one or more dove-tail protrusions extending radially outward from the at least one lobe, and a pad disposed on the at least one lobe and the one or more dove-tail protrusions;

contacting the pad against an inner wall of a marine riser and/or the wellhead installation; and absorbing acoustic noise generated within the marine riser and/or the wellhead installation with the pad, and thereby improving acoustic communication in the acoustic telemetry system.

12. The method of claim 11, further comprising:

arranging a sleeve between the body and the pipe string, the sleeve having an inner diameter and an outer diameter; and absorbing with the sleeve acoustic noise generated within the marine riser and/or the wellhead installation, thereby improving acoustic communication in the acoustic telemetry system.

13. The method of claim 12, further comprising selecting the sleeve based on a radial thickness equal to a difference between the inner diameter and the outer diameter of the sleeve, the radial thickness being sized to accommodate a corresponding size of the pipe string.

14. The method of claim 11, wherein contacting the pad against an inner wall of a marine riser and/or a wellhead installation comprises contacting a tapered biasing surface of the pad against a wear bushing arranged within the wellhead installation.

15. The method of claim 11, wherein contacting the pad against an inner wall of a marine riser and/or a wellhead installation comprises contacting a radial biasing surface of the pad against the inner wall of the wellhead installation.

16. The method of claim 11, wherein the pad is made of an acoustic dampening material.

17. The method of claim 16, wherein the acoustic dampening material is a hydrogenated nitrile butadiene rubber.

18. The method of claim 11, further comprising arranging the well system component at or near a flex joint of the wellhead installation.

19. The method of claim 11, further comprising arranging the well system component at or near a rig floor of a semi-submersible offshore rig installation.

* * * * *